US009316028B2

(12) United States Patent
Hunt et al.

(10) Patent No.: US 9,316,028 B2
(45) Date of Patent: Apr. 19, 2016

(54) VEHICLE DOOR LATCH

(71) Applicant: Kiekert AG, Heiligenhaus (DE)

(72) Inventors: Robert J. Hunt, Davisburg, MI (US); Robert S. Pettengill, Farmington, MI (US)

(73) Assignee: Kiekert AG, Heiligenhaus (DE)

( * ) Notice: Subject to any disclaimer, the term of this patent is extended or adjusted under 35 U.S.C. 154(b) by 211 days.

(21) Appl. No.: 14/100,334

(22) Filed: Dec. 9, 2013

(65) Prior Publication Data

US 2015/0159406 A1 Jun. 11, 2015

(51) Int. Cl.

| | |
|---|---|
| ***E05C 3/06*** | (2006.01) |
| ***E05B 79/10*** | (2014.01) |
| ***E05B 77/00*** | (2014.01) |
| ***E05B 79/00*** | (2014.01) |
| ***E05B 79/14*** | (2014.01) |
| ***E05B 85/02*** | (2014.01) |
| ***E05B 85/26*** | (2014.01) |
| *E05C 3/16* | (2006.01) |
| *E05B 85/24* | (2014.01) |

(52) U.S. Cl.

CPC ..... *E05B 79/10* (2013.01); *E05B 77/00* (2013.01); *E05B 79/00* (2013.01); *E05B 79/14* (2013.01); *E05B 85/02* (2013.01); *E05B 85/26* (2013.01); *E05B 85/24* (2013.01); *Y10T 292/1047* (2015.04)

(58) Field of Classification Search

CPC ..... E05C 3/004; E05C 3/006; E05C 3/008; E05B 79/00; E05B 79/10; E05B 79/12; E05B 79/14; E05B 77/00

USPC ..... 292/194, 195, 198, 201, 216, DIG. 42

See application file for complete search history.

(56) References Cited

U.S. PATENT DOCUMENTS

| | | | | | |
|---|---|---|---|---|---|
| 1,544,960 | A | * | 7/1925 | Watts | 292/216 |
| 2,217,098 | A | * | 10/1940 | Brownne | 292/198 |
| 3,087,749 | A | * | 4/1963 | Capton | 292/99 |
| 3,171,677 | A | * | 3/1965 | Klove, Jr. et al. | 292/216 |
| 3,262,725 | A | * | 7/1966 | Ballantyne | 403/49 |
| 3,408,100 | A | * | 10/1968 | McKey | 292/216 |
| 3,890,813 | A | * | 6/1975 | Cothron | 70/92 |
| 7,128,349 | B2 | | 10/2006 | Bendel et al. | |
| 2011/0133491 | A1 | * | 6/2011 | Perkins et al. | 292/216 |

* cited by examiner

*Primary Examiner* — Carlos Lugo

(74) *Attorney, Agent, or Firm* — Renner, Otto, Boisselle & Sklar, LLP

(57) ABSTRACT

A vehicle door latch includes a lock plate, a catch which is rotatable about a first rotary axis, and a pawl which is rotatable about a second rotary axis, the first rotary axis and the second rotary axis being non-parallel. A connector connects both the catch and the pawl to the lock plate. One end of the connector connects the catch to the lock plate, and an opposite end of the connector connects the pawl to the lock plate. The connector is a dual rivet in that the connector has a first end face and a second end face, wherein the end faces are riveted outside of the lock plate. The lock plate includes a slot through which one end of the connector extends, and the slot extends in a direction of a projection of one of the rotary axes.

7 Claims, 2 Drawing Sheets

VEHICLE DOOR LATCH

FIELD OF THE INVENTION

The invention relates to a vehicle door latch including a lock plate, a catch, a pawl and a connector which connects the catch and the pawl to the lock plate.

DESCRIPTION OF RELATED ART

The document U.S. Pat. No. 7,128,349 B2 discloses a motor-vehicle door latch with two spaced rigid lock plate parts. The latch further includes a standard latch fork rotating about a first pivot pin, and a retaining pawl rotating about a second pivot pin. The rotary axis of the latch fork and the retaining pawl are parallel, and the pivot pins are connected via a flange.

SUMMARY OF THE INVENTION

The invention described herein provides a vehicle door latch including a lock plate, a catch which is rotatable about a first rotary axis, and a pawl which is rotatable about a second rotary axis. The first rotary axis and the second rotary axis are non-parallel, which means that the first rotary axis and the second rotary axis form an angle larger than 0 degrees and smaller than 180 degrees. Preferably, this angle is between 75 and 105 degrees, further preferably between 85 and 95 degrees, still further preferably about 90 degrees, and in particular this angle is exactly 90 degrees. The vehicle door latch further includes a connector which connects both the catch and the pawl to the lock plate. In other words, the catch and the pawl are not fixed to the lock plate separately, but by the same connector as a fixing device. Connecting the catch or the pawl to the lock plate means attaching the catch or the pawl to the lock plate such that a rotary movement about the rotary axis is possible, but a lateral movement along the rotary axis is restricted or even prevented.

The lock plate preferably includes two planar regions which are angled towards each other, preferably with an angle of 90 degrees between the planar regions. The lock plate can be a single lock plate or a combined lock plate having two or more lock plate members which are connected to each other. The lock plate is a carrier or frame which carries components of the vehicle door latch. In one embodiment, the lock plate forms a housing of the vehicle door latch or at least a part thereof.

In this document, a vehicle door can be any closable opening of a vehicle, such as a side door, an engine hood, a trunk or any lift gate. The term "rotary axis" may mean a physical axis, such as a pivot or a shaft, about which an object actually rotates, or a virtual line which only defines the orientation of the rotation.

With a single connector connecting both the catch and the pawl to the lock plate of the door latch, less parts are required for manufacturing the door latch. In addition, the connector increases the stability and ultimate strength of the lock plate by triangulating the load.

In one embodiment, the connector has two ends, wherein one end of the connector connects the catch to the lock plate, and the other, opposite end of the connector connects the pawl to the lock plate. In particular, the connector is an elongate member having a bend of an angle which equals the angle between the first and second rotary axes.

Preferably, the connector is formed integrally. This means that the connector is a single piece.

In general, the connector can be any member which is suitable for connecting the catch and the pawl to the lock plate. In a typical embodiment, the connector extends through an opening in the catch or the pawl and through an opening in the lock plate. The connector is then fixed to the lock plate on the side which is opposite to the catch or the pawl, respectively.

In one embodiment, the connector is a dual rivet. This means that the connector has two ends which extend through the catch and the pawl, respectively, and a corresponding opening in the lock plate, and is then riveted on the side of the lock plate which is opposite to the catch or the pawl, respectively.

In one embodiment, the connector has at least one stop for the catch and/or the pawl. The stop limits the axial movement, that is the movement along the rotary axis, of the catch or the pawl. In the opposite direction, the axial movement of the catch or the pawl is limited either directly or indirectly, for example via an intermediate member, by the lock plate. Preferably, the connector has two stops, that is one stop for the catch and one stop for the pawl. A stop might limit the axial movement of the catch or the pawl indirectly, for example via a bearing which is located between the stop and the catch or the pawl.

In one embodiment, the lock plate includes a slot through which one end of the connector extends. This slot has a width and a length. The width of the slot is slightly larger than the size of the end of the connector such that the end of the connector can pass through the slot. The length of the slot is larger than the width of the slot. The slot enables an easy assembly of the door latch because the connector remains movable, for example rotatably or translationally along the length of the slot.

Preferably, the slot extends in a direction of a projection of the rotary axis which does not extend through the slot onto the lock plate. The direction of the extension of the slot refers to the direction of the length of the slot. If, for example, the end of the connector which is used to connect the pawl to the lock plate extends through the slot, then the slot extends in the direction which is obtained by projecting the rotary axis of the catch onto the surface of the lock plate in which the slot is provided. In other words, the slot extends such that the end of the connector can be moved within the slot towards the opening in the lock plate through which the other end of the connector extends.

BRIEF DESCRIPTION OF THE DRAWINGS

Below, the invention is explained in more detail with reference to drawings which show.

DETAILED DESCRIPTION OF THE INVENTION

Figure 1:
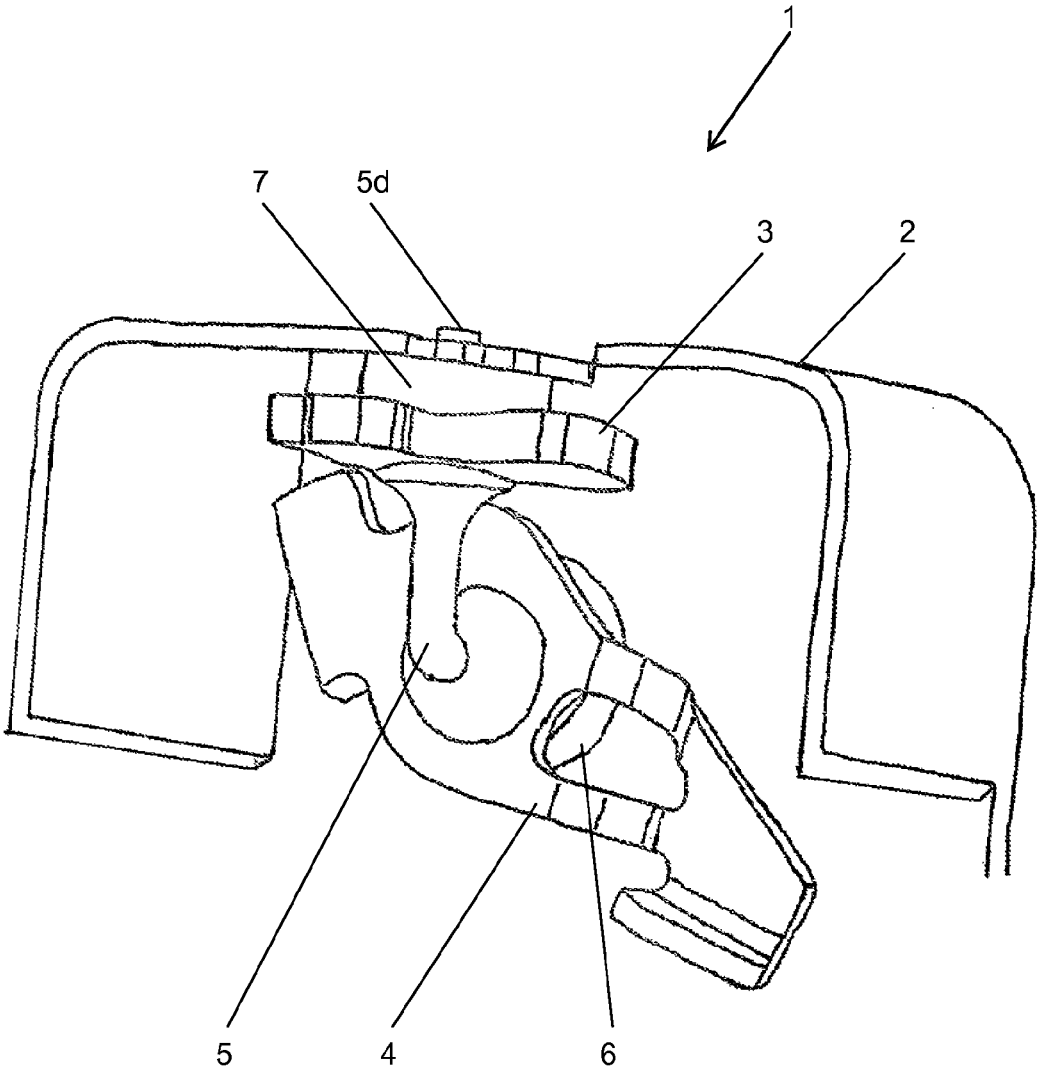
FIG. 1 a vehicle door latch.

FIG. 1 shows a partial, sectional and perspective view of a vehicle door latch 1. Only components of the vehicle door latch 1 which are important for the present invention are shown in FIG. 1. Other components are omitted in order to increase the comprehension of the drawing.

The vehicle door latch 1 includes a lock plate 2, only a part of which is shown in FIG. 1. On the lock plate 2, a catch 3 and a pawl 4 are provided. The catch 3 is connected to one part or region of the lock plate 2 such that the catch 3 is rotatable about a first rotary axis. The pawl 4 is connected to another part or region of the lock plate 2 such that the pawl 4 is rotatable about a second rotary axis. A single connector 5 is provided which connects both the catch 3 and the pawl 4 to the lock plate 2.

The catch 3 and the pawl 4 are designed as known in the art. In particular, the catch 3 has a cut which is designed to interact with a locking pin, in particular to catch the locking pin, in order to lock the vehicle door. In an open position, the cut receives the pin, and in a closed position, the catch 3 cannot release the locking pin.

The pawl 4 is designed to interact with the catch 3. In particular, the pawl 4 locks the catch 3 in its closed position. The catch 3 can only transition from its closed position to its open position if the pawl 4 does not block the rotational movement of the catch 3.

Between the catch 3 and the lock plate 2, an optional bearing 7 is provided. This bearing 7 facilitates the rotation of the catch 3 by reducing the friction between the catch 3 and the lock plate 2. A biasing element 6 is provided between the pawl 4 and the lock plate 2. This biasing element 6, such as a leg spring, causes a rotational bias on the pawl 4 which urges the pawl 4 into a position in which it locks the transition of the catch 3 from its closed to its open position. The biasing element 6 is optional. The biasing element 6 may include a bearing to facilitate the rotation of the pawl 4.

The design of the lock plate 2, the catch 3 and the pawl 4 are not particularly limited and can be selected according to the specifications of the vehicle door latch 1 or the environment in which the vehicle door latch 1 is to be used. The only constraint is that the first rotary axis and the second rotary axis are not parallel. In other words, the two rotary axes constitute an angle which is larger than 0 degrees and smaller than 180 degrees.

One effect achieved by the angled single connector 5 is that the locking plate 2 is strengthened from deformations, in particular in an axial direction of the catch 3.

Figure 2:
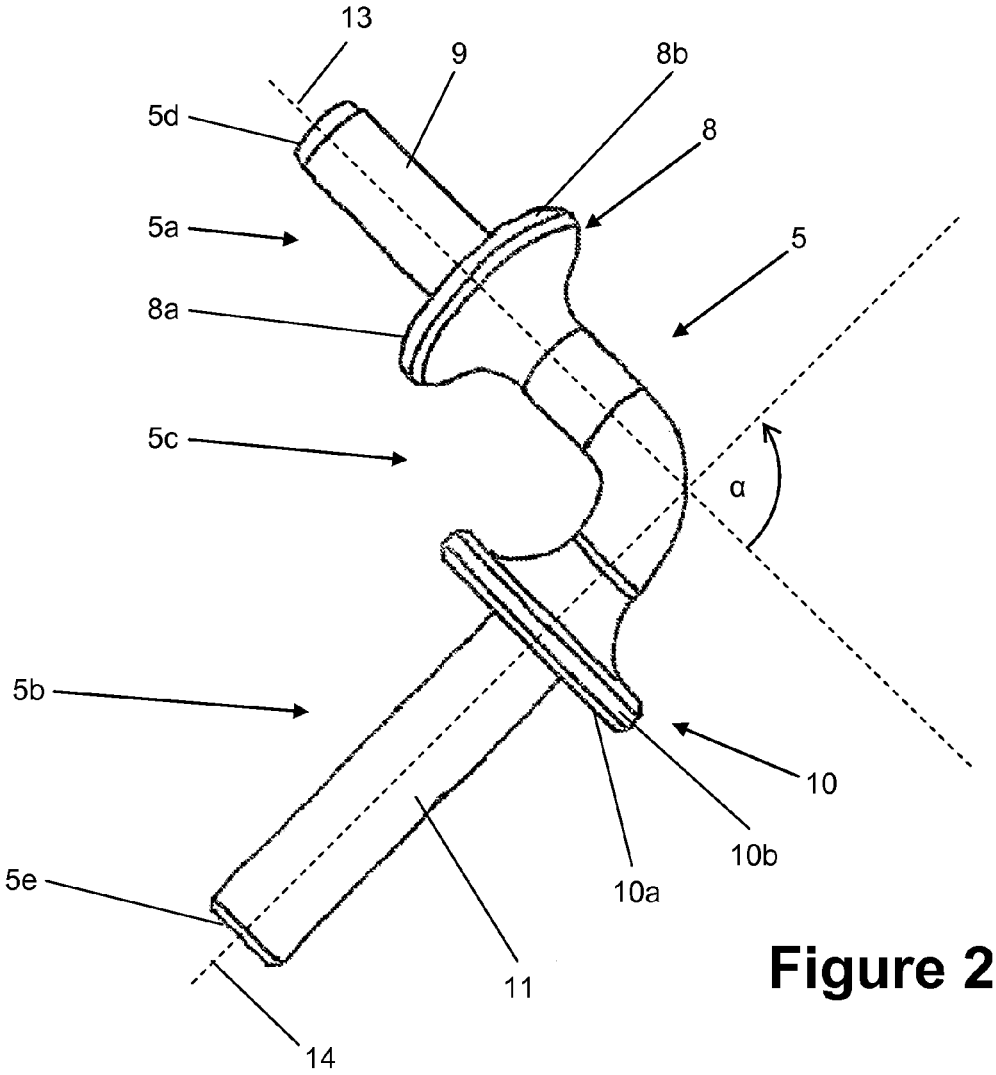
FIG. 2 a connector used in the vehicle door latch of FIG. 1.

FIG. 2 shows the connector 5 in more detail. The exemplary connector 5 includes a first end section 5*a*, a second end section 5*b* and a central section 5*c* which connects the end sections 5*a* and 5*b*. The end section 5*a* defines the first rotary axis 13 of the catch 3, and the second end section 5*b* defines the second rotary axis 14 of the pawl 4. As can be seen in FIG. 2, the two rotary axes 13 and 14 form an angle a as explained above, wherein $\alpha$ is larger than 0 degrees and smaller than 180 degrees. Preferably, the angle $\alpha$ lies between 80 and 100 degrees, further preferably between 85 and 95 degrees. In particular, the angle $\alpha$ preferable may be exactly 90 degrees.

In the present embodiment, the connector 5 is a dual rivet. This means that the two end faces of the connector 5, that is the end face 5*d* of the end section 5*a* and the end face 5*e* of the end section 5*b*, can be riveted on the outside of the lock plate 2 in order to attach the catch 3 and the pawl 4 to the lock plate 2. The expression "outside of the lock plate" might mean "outside of a part of the lock plate in which the catch 3 and the pawl 4 are located".

The connector 5 includes a first stop 8 which separates the end section 5*a* from the central section 5*c* and a second stop 10 which separates the end section 5*b* from the central section 5*c*. The first stop 8 limits or prevents an axial movement of the catch 3, and the second stop 10 limits or prevents an axial movement of the pawl 4.

In one embodiment, the first stop 8 optionally includes a rotatable stop face 8*a* which is connected to the central section 5*c* of the connector 5 via a bearing 8*b*. The stop face 8*a* can thus rotate about the first rotary axis together with the catch 3 such that there is no relative rotational movement between the stop face 8*a* and the catch 3.

The first end section 5*a* at least partly has a first cylindrical surface 9. This cylindrical surface 9 preferably is static with respect to the central section 5*c* of the connector 5. The cylindrical surface 9 might have a coating with a low friction.

The second stop 10 preferably has the same structure as the first stop 8. This means that the stop 10 has a stop face 10*a* for getting in contact with the pawl 4, wherein the stop face 10*a* is connected to the central section 5*c* of the connector 5 via a bearing 10*b*. The end section 5*b* at least partly has a second cylindrical surface 11 which preferably is static with respect to the central section 5*c* of the connector 5.

The bearing 8*b* or the bearing 10*b* might not be a part of the first stop 8 or the second stop 10, respectively, and thus of the connector 5. A bearing might instead be a separate component which is arranged between a stop and the catch 3 or the pawl 4. The stop face 8*a* or the stop face 10*a* is then a part of the bearing as a separate component.

The first cylindrical surface 9 can have the same diameter as the second cylindrical surface 11. In another embodiment, the diameters of the cylindrical surfaces 9 and 11 can be different from each other.

Although FIG. 2 shows an asymmetrical connector 5 with end sections 5*a* and 5*b* of different sizes, the end sections 5*a* and 5*b* can be designed to be symmetrical or identical in another embodiment of the invention. In addition, the complete connector 5 can be designed as a symmetrical part, wherein the symmetrical connector preferably possesses a 90° angle. This means that the connector is brought to a 90° position.

When assembled as shown in FIG. 1, the stop face 8*a* is in contact with the catch 3. The bearing 7 is sandwiched between the catch 3 and a surface of one part of the lock plate 2. The end section 5*a* extends through the catch 3, the bearing 7 and an opening in the part of the lock plate 2 such that the end face 5*d* can be riveted on the outside of the lock plate 2.

Comparably, the stop face 10*a* contacts the pawl 4, and the biasing element 6 is sandwiched between the pawl 4 and a surface of one part of the lock plate 2. The end section 5*b* of the connector 5 extends through the pawl 4, the biasing element 6 and an opening in the part of the lock plate 2. The end face 5*e* of the connector 5 can be riveted on the outside of the lock plate 2.

Figure 3:
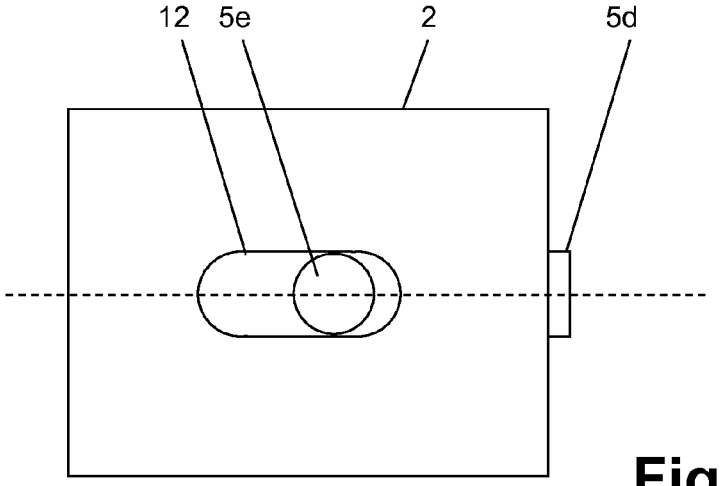
FIG. 3 a side view of the vehicle door latch of FIG. 1.

FIG. 3 shows a schematic side view of the vehicle door latch 1. One part of the lock plate 2 has an opening 12 through which the end section 5*b* of the connector 5 can extend such that the end face 5*e* is located on the outside of the lock plate 2. The opening 12 is a slot, wherein the width of the slot 12 is large enough to accommodate the end section 5*b* of the connector 5, but small enough such that the end face 5*e* of the connector 5 can be riveted.

The dashed line in FIG. 3 indicates the projection of the first rotary axis 13 of the catch 3 onto the part of the lock plate 2 in which the slot 12 is provided. The slot 12 extends in the direction of this projection. With the opening 12 being a slot rather than a circular opening, the connector 5 can be moved in the direction of the projection during assembly of the vehicle door latch 1. In particular, the end section 5*b* of the connector 5 is first inserted into the opening 12 and then the connector 5 is moved until the other end section 5*a* extends through the opening in the other side of the lock plate 2.

This invention is not to be limited to the specific embodiments disclosed herein and modifications for various applications and other embodiments are intended to be included within the scope of the appended claims. While this invention has been described in connection with particular examples thereof, the true scope of the invention should not be so limited since other modifications will become apparent to the skilled practitioner upon a study of the drawings, specification and appended claims. In particular, the scope of the present invention includes all possible combinations of the features cited in all claims, which includes multiple dependencies of the dependent claims such that a dependent claim may depend on any preceding claim.

The invention claimed is:

1. A vehicle door latch comprising:

a lock plate, a catch which is rotatable about a first rotary axis, a pawl which is rotatable about a second rotary axis, the first rotary axis and the second rotary axis being non-parallel, and a connector which connects both the catch and the pawl to the lock plate;

wherein two ends of the connector extend through openings in the lock plate.

2. The vehicle door latch according to claim 1, wherein one end of the connector connects the catch to the lock plate, and an opposite end of the connector connects the pawl to the lock plate.

3. The vehicle door latch according to claim 1, wherein the connector is formed integrally as a single piece.

4. The vehicle door latch according to claim 1, wherein the connector has a first end face and a second end face, wherein the end faces are riveted outside of the lock plate.

5. The vehicle door latch according to claim 1, wherein the connector has at least one stop for at least one of the catch or the pawl.

6. A vehicle door latch comprising:

a lock plate, a catch which is rotatable about a first rotary axis, a pawl which is rotatable about a second rotary axis, the first rotary axis and the second rotary axis being non-parallel, and a connector which connects both the catch and the pawl to the lock plate;

wherein the lock plate comprises a slot through which one end of the connector extends.

7. The vehicle door latch according to claim 6, wherein the slot extends in a direction of a projection of one of the first or second rotary axes which does not extend through the slot onto the lock plate.

* * * * *